United States Patent [19]

Guill et al.

[11] Patent Number: 4,694,267

[45] Date of Patent: Sep. 15, 1987

[54] WAVEGUIDE DEHYDRATOR APPARATUS

[75] Inventors: Dennis J. Guill, Richardson; Larry D. McPherson, Allen; John H. Sizelan, Eastland, all of Tex.

[73] Assignee: Rockwell International Corporation, El Segundo, Calif.

[21] Appl. No.: 894,424

[22] Filed: Aug. 8, 1986

[51] Int. Cl.[4] ..... H01P 1/30

[52] U.S. Cl. ..... 333/248; 55/316; 333/99 R

[58] Field of Search ..... 34/1, 80; 55/316, 387; 333/248, 99 R

[56] References Cited

U.S. PATENT DOCUMENTS 3,778,799 12/1973 Bendayan ..... 333/248 X 4,504,289 3/1985 Waller ..... 55/316

*Primary Examiner*—Paul Gensler

*Attorney, Agent, or Firm*—Bruce C. Lutz; George A. Montanye; H. Fredrick Hamann

[57] ABSTRACT

Dessicant vessel allows air to flow through desiccant from a temperature related pumping phenomena prior to entry into waveguide to guard against attenuation of microwave signal.

3 Claims, 3 Drawing Figures

WAVEGUIDE DEHYDRATOR APPARATUS

THE INVENTION

The present invention is generally concerned with waveguides, and more specifically concerned with a method of minimizing moisture in the waveguide enclosures or cavities.

BACKGROUND OF THE INVENTION

As is well known, moisture in a waveguide cavity causes attenuation of signals passing therethrough. Attempts to evacuate the waveguide cavity have failed in the past, since the seals eventually leak and moisture, as part of the entering air, has contaminated the interior cavity of the waveguide. A normal solution to the problem is to continuously pressurize the waveguide with dry air, so that air is always leaking out of the waveguide rather than being drawn in whenever the temperature changes are such that the pressure inside the waveguide is lower than the pressures outside.

The prior art approach of pressurizing the waveguide has involved an expense of several hundred dollars for a pump and occasionally a heater, plus the expenses of maintaining and operating this equipment.

In general, the prior art devices have situated the radio in a building using a fairly long waveguide to supply signals to the antenna.

As the signal frequencies get higher, it becomes more important that the distance between the radio and the antenna be kept short to minimize signal losses. In situations where the radio equipment is located near the antenna and is not protected from the environment by being inside a building, it also means that any pressurization equipment is also subject to environmental problems.

The present invention overcomes many of these problems in the prior art by attaching a desiccant vessel to a test port on the waveguide, and mounting the radio as close as possible to the antenna, so that the total waveguide length affected by moisture is minimized. In such a configuration, the pumping phenomena created by changes in temperature resulting in movement of air in and out of the waveguide, will pass all the air through the desiccant vessel rather than attempting to draw the air through joints in the waveguide. By attaching the desiccant vessel to the test port in an easily removable manner, this port can serve a dual function of normally providing dry air to the waveguide and, in special instances, serve as a signal level detection point for test equipment.

It is thus an object of the present invention to improve upon prior art approaches of minimizing moisture in a waveguide.

Other objects and advantages of the present invention will be apparent from a reading of the specification and appended claims in conjunction with the drawings, wherein:

DETAILED DESCRIPTION

Figure 1:
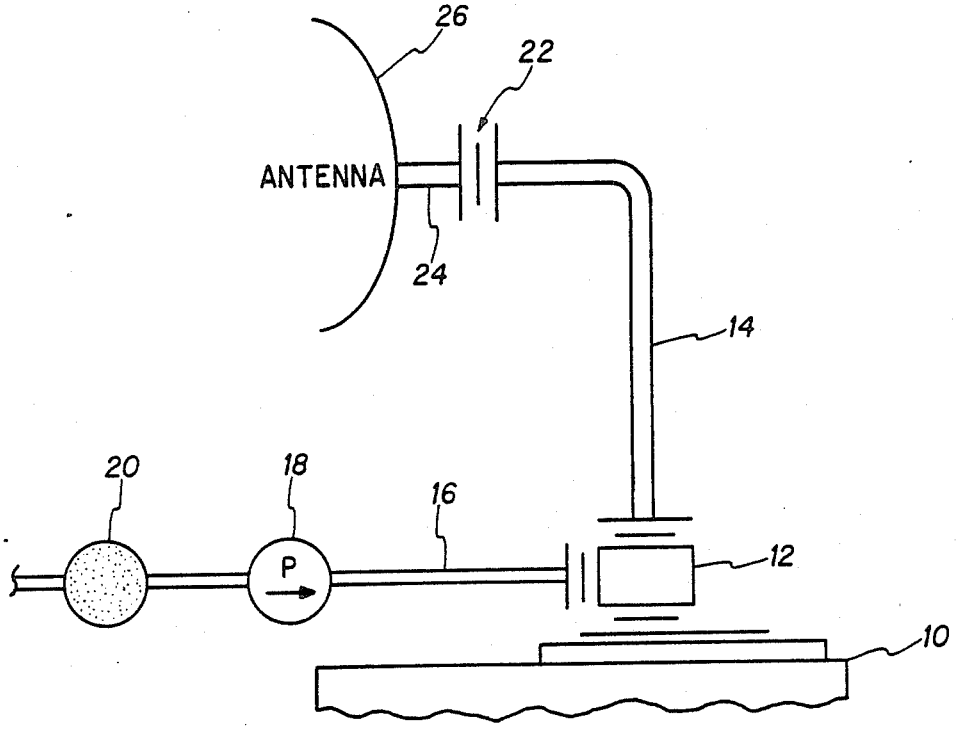
FIG. 1 PRIOR ART
FIG. 1 is a illustrative diagram of the prior art approach to the problem.

In FIG. 1, a box 10 represents an enclosure for a radio transmitter or other device for generating microwave signals to be transmitted through a waveguide. A pressure port 12 is shown attached to the block 10 having an output port to a waveguide 14 and to a conduit 16. A pump 18 is connected to supply dry pressurized air through tube 16 to the waveguide 14. Pump 18 receives the dry air from a source, such as a desiccant filled vessel 20. The waveguide 14 is connected through some port or connection means 22 to a final section of waveguide 24 supplying signals to antenna 26.

Figure 2:
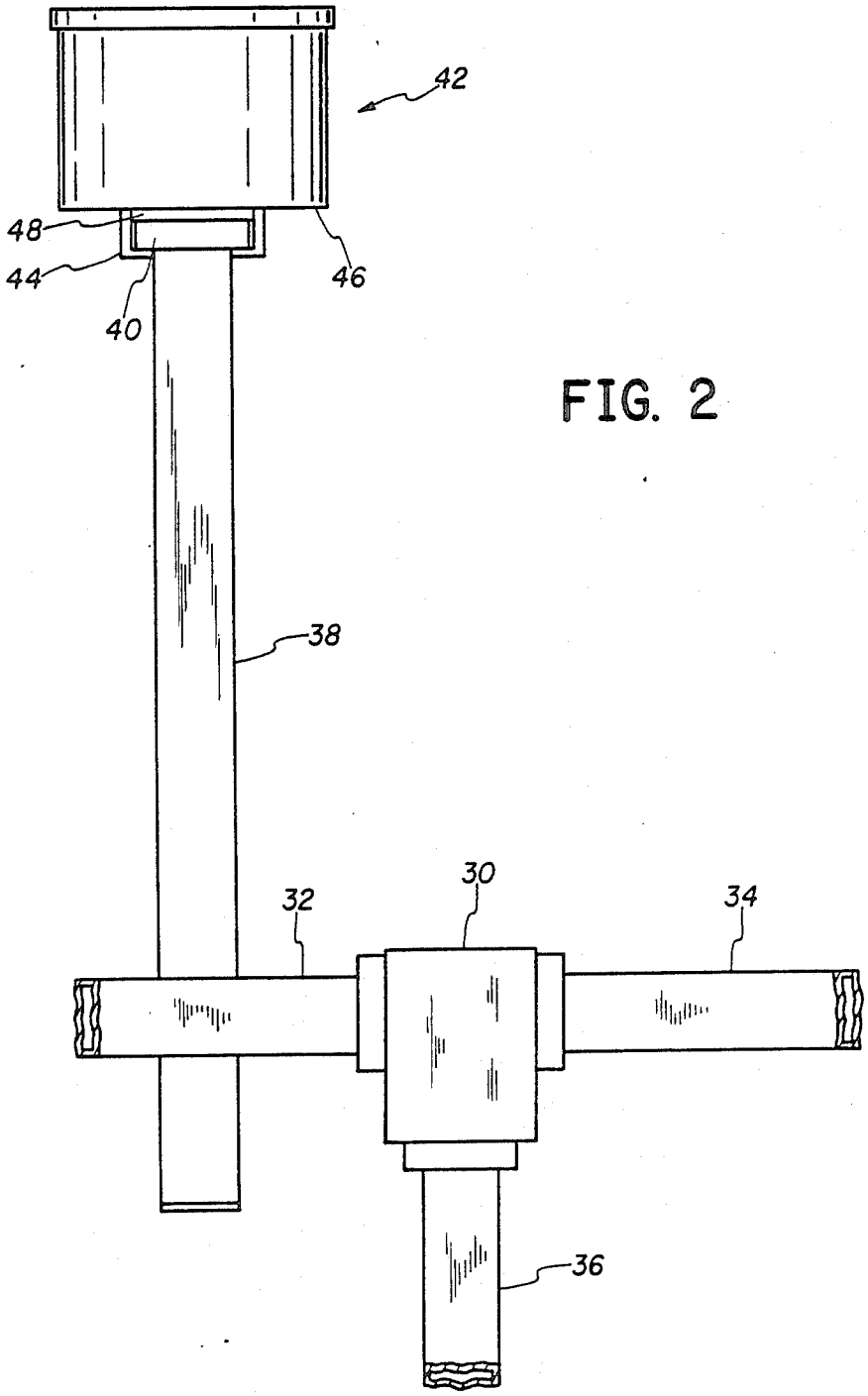
FIG. 2 is a detailed illustration of a portion of a waveguide including the desiccant vessel.

In FIG. 2, a signal dividing means 30 is connected to three sections of waveguide 32, 34 and 36. A further waveguide portion 38 is connected in a signal dividing manner to receive a portion of the signals from waveguide 32. At one extremity of waveguide 38 is a flange 40 upon which is attached generally a desiccant filled container 42. A shoe or guide means 44 attached to a base 46 of the container 42 holds the container 42 firmly in place and attached in a reasonably airtight manner to the flange 40 of waveguide 38. A seal is provided by a sealing means 48 between base 46 and flange 40.

Figure 3:
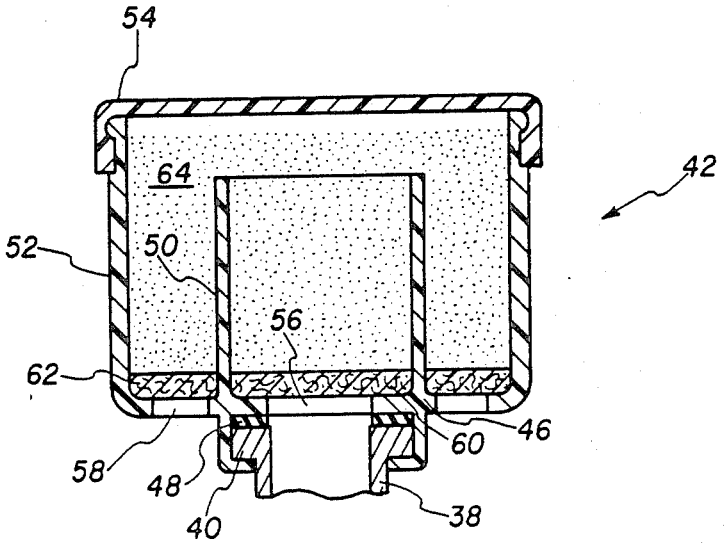
FIG. 3 is an illustration showing in more detail the interior of a preferred embodiment of a desiccant vessel using the teachings of the present invention.

The same numbers are used in FIG. 3, where appropriate, as are used in FIG. 2. Since FIG. 3 represents a cutaway view of the desiccant vessel 42, additional material that can be observed is an interior cylindrical portion 50 and an external cylindrical portion 52 along with a cover 54. As will also be observed, there is an opening 56 in the base for communicating between the interior of cylinder 50 and the waveguide 38. Also, there is an opening designated as 58 in the portion of the base 46 between cylinder 50 and cylinder 52. A desiccant filter or air permeable/desiccant impermeable means 60 prevents the desiccant from passing from the interior of vessel 42 to the waveguide 38, and a further filter means 62 prevents the desiccant from falling out of the container through the opening 58. Finally, the vessel 42 is filled with a desiccant generally designated as 64.

OPERATION

As previously indicated, and as illustrated in FIG. 1, one prior art approach to preventing the introduction of moisture into a waveguide was to use a pressurizing means, such as pump 18, to supply a pressure to the interior of the waveguide 14, wherein air could only leak from the waveguide rather than leak into the waveguide. The source of air for the pump would have to be dry air, and this can be provided by passing the air through a desiccant vessel, such as 20, before being used to pressurize the waveguide system.

The present system allows the removal of a pressurizing pump as long as a source of dry air in the form of a desiccant vessel is attached at a location within a relatively short distance of all portions of the waveguide. Under such a configuration, the pumping phenomena associated with temperature changes will draw all air into the waveguide through the desiccant vessel rather than the sealed joints, such as illustrated by 22 in the prior art FIG. 1.

Further, by designing the desiccant vessel to be easily attached to a test port, the port can be used as a dual function device of a source for dry air and a source for test type signals from the system.

Applying the illustration of FIG. 2 to an actual system, a source of signals to be transmitted may be applied from conduit 34 to output conduit 32 and hence to the antenna, such as 26 of FIG. 1, while returning signals are received from waveguide 32 and output to a receiver in the radio via waveguide 36. The portion 30, as previously mentioned, is a signal splitter.

While we have disclosed a preferred embodiment of our invention using a specific style of desiccant vessel, attached to a test port, we wish to be limited only by the inventive concept as defined in the appended claims, wherein we claim:

1. Waveguide apparatus comprising, in combination:

a radio;

an antenna;

waveguide means connected between said radio and said antenna for passing signals between said radio and said antenna, said waveguide means including a further port; and desiccant vessel means directly attached to said further port and otherwise open to the environment for removing moisture from air drawn into the waveguide means by a pumping phenomena created by changes in temperature.

2. Desiccant vessel apparatus comprising, in combination:

a base, including seal and guide means, for attachment, in a reasonably airtight friction fit sliding relationship, to a waveguide port including an opening therein whereby air can pass through an opening in said base to said waveguide;

a first cylinder of a given height mounted on said base and open at each end encompassing the opening in said base;

a second cylinder of a height greater than said given height mounted on said base and having openings at each end with the openings in the base being outside the area of the waveguide port attachment portion of said base;

first means for providing air permeable/desiccant impermeable action occupying the base portions of the interior of said first and second cylinders;

a desiccant occupying the remaining volume of said first and second cylinders; and a cover for sealing the openings at the end of said second cylinder which is not attached to said base.

3. In waveguide apparatus wherein moisture drawn into the waveguide through a pumping phenomena created by changes in temperature may cause attenuation of signals passing therethrough the improvement comprising, in combination:

a waveguide sealed to prevent passage of air between the interior and exterior thereof except through a moisture removing port; and desiccant means removably attached to said moisture, removing port for removing moisture from any air drawn into the interior of said waveguide.

* * * * *